United States Patent [19]

Ross

[11] 3,934,822

[45] Jan. 27, 1976

[54] WATER POWERED DISHWASHER

[76] Inventor: Jack Ross, 230 Richmond St. East, Toronto, Ontario, Canada

[22] Filed: July 29, 1974

[21] Appl. No.: 492,393

[52] U.S. Cl. ..... 239/226; 134/93; 239/310

[51] Int. Cl.[2].... B05B 3/00; A62C 5/02; B05B 7/26; B08B 3/00

[58] Field of Search ..... 239/310, 318, 226; 134/93, 134/100, 176, 179

[56] References Cited

UNITED STATES PATENTS

| | | | |
|---|---|---|---|
| 1,408,077 | 2/1922 | Clinton | 239/226 |
| 1,475,489 | 11/1923 | Hicks | 134/179 |
| 2,580,629 | 1/1952 | Wenzel | 239/226 |
| 2,692,165 | 10/1954 | Sinkwich | 134/93 |
| 3,327,722 | 6/1967 | Nolte | 134/176 |
| 3,807,636 | 4/1974 | Fackler | 239/226 |

*Primary Examiner*—Lloyd L. King

[57] ABSTRACT

An improved water powered dishwasher is provided having an improved soap dispenser which will not rust or clog with prolonged use. The soap dispenser utilizes suction to admix the soap from the dispenser with the water and provides a more uniform soap-water mixture for spraying onto the dishes.

17 Claims, 3 Drawing Figures

FIG. 2
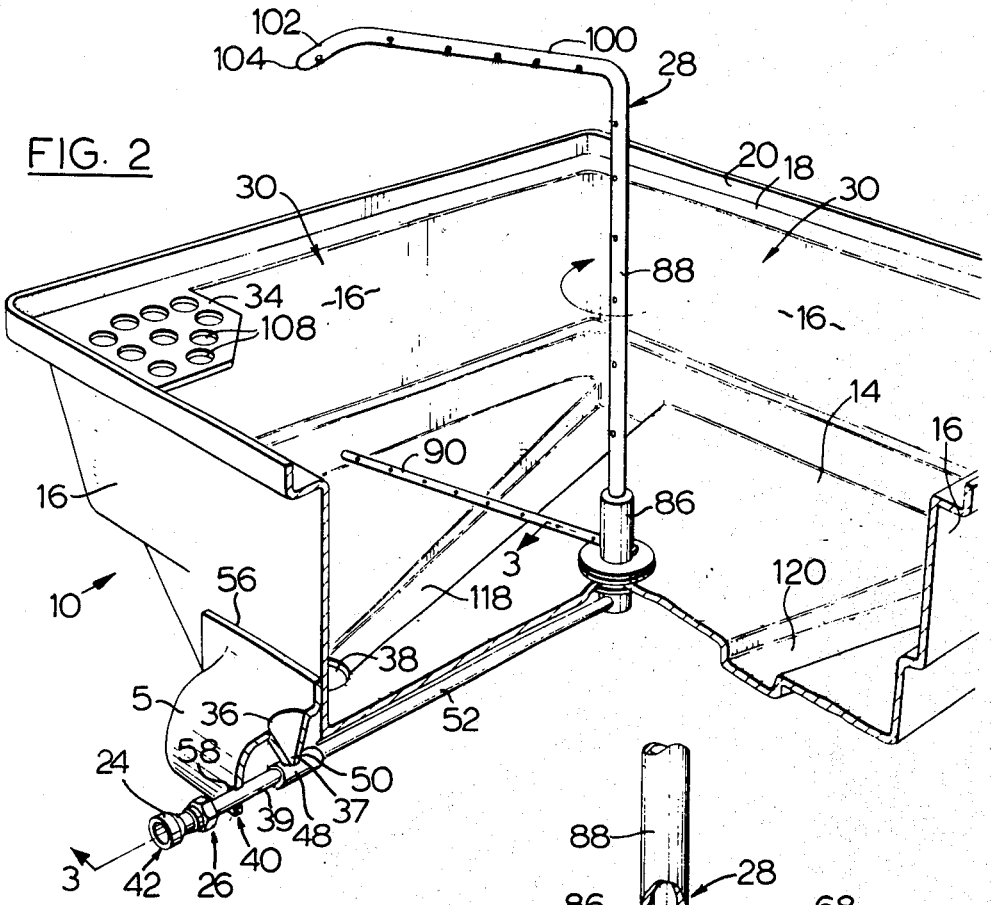
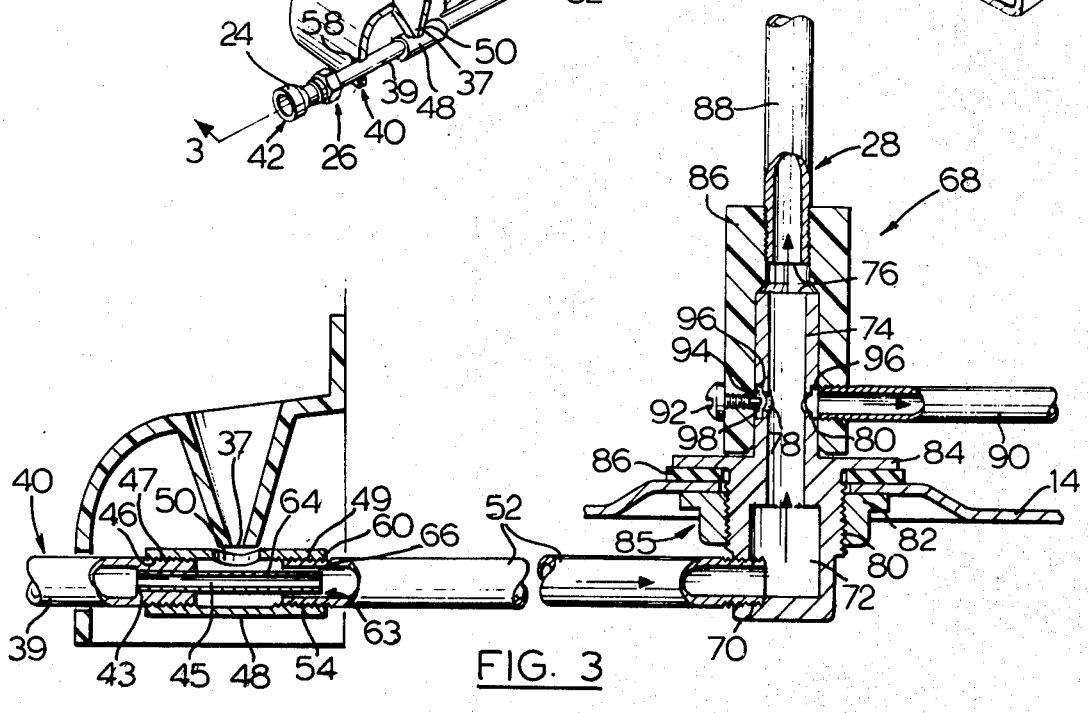
FIG. 3

WATER POWERED DISHWASHER

FIELD OF INVENTION

This invention relates to improvements in water powered dishwashers and components therefor.

BACKGROUND OF THE INVENTION

In my co-pending-application Ser. No. 466,198, I disclosed an improved dishwasher over those previously known. However the dispensing of the soap and the dispenser therefor, was not entirely satisfactory. In particular, due to the dispenser's construction, soap was dispensed too quickly into the water and thus more concentrated than necessary for effective washing, and the dispenser corroded easily due in part to its material construction and in part to the fact that it was not easily rinsed. Furthermore, if the cap of the dispenser was inadvertantly not secured tightly onto the mouth of the dispenser, back-pressure of the water could force the cap and eject a soap water mixture into the surroundings.

It is therefore an object of this invention to provide an improved dishwasher and components therefor wherein the aforementioned difficulties are overcome.

It is a further object of the invention to provide a dispenser wherein a uniform concentration of soap and water is provided for a more uniform soaping of the dishes in the washing cavity throughout the entire washing cycle.

The above and other objects, features and advantages of the invention will be realized by those persons skilled in the art from the following summary of the invention and more detailed description of a preferred embodiment thereof.

SUMMARY OF THE INVENTION

According to one important aspect of the invention an improved soap dispenser for the improved dishwasher is provided wherein soap is dispensed into the water at a uniform rate both by suction and gravity feed from storage.

According to another aspect of the invention, suction means is provided in the water inlet and includes an opening in the top of the inlet, vertically aligned with a soap storage discharge and disposed a predetermined distance from the mouth of the inlet, and an inner conduit of restricted radial dimension secured in the water inlet through which all water entering the mouth of the water inlet passes, and extending, from a position intermediate the mouth of the inlet and the opening, below the opening, to the other side thereof remote from the mouth, to discharge the water passing therethrough into a conduit of greater radial dimension.

According to another important aspect of the invention, a cavity is provided in the water inlet below the opening between the outer surface wall of the inner conduit and the inner surface wall of the inlet in which the opening is disposed, into which cavity the soap is discharged through the opening.

According to another aspect of the invention the outlet apertures in the water inlet through which the water is discharged from the water inlet into the rotatable spray unit are of such dimensions so as to prevent back-pressure build-up in the water inlet.

BRIEF DESCRIPTION OF A PREFERRED EMBODIMENT OF THE INVENTION

The invention will now be illustrated with reference to the accompanying drawings in which a preferred embodiment is described and in which:

FIG. 2 is a perspective view, partly in section of the shell of the dishwasher.

FIG. 3 is a partial cross-section along the line 3—3 in FIG. 2 looking in the direction of the arrows.

DETAILED DESCRIPTION OF A PREFERRED EMOBDIMENT OF THE INVENTION

Figure 1:
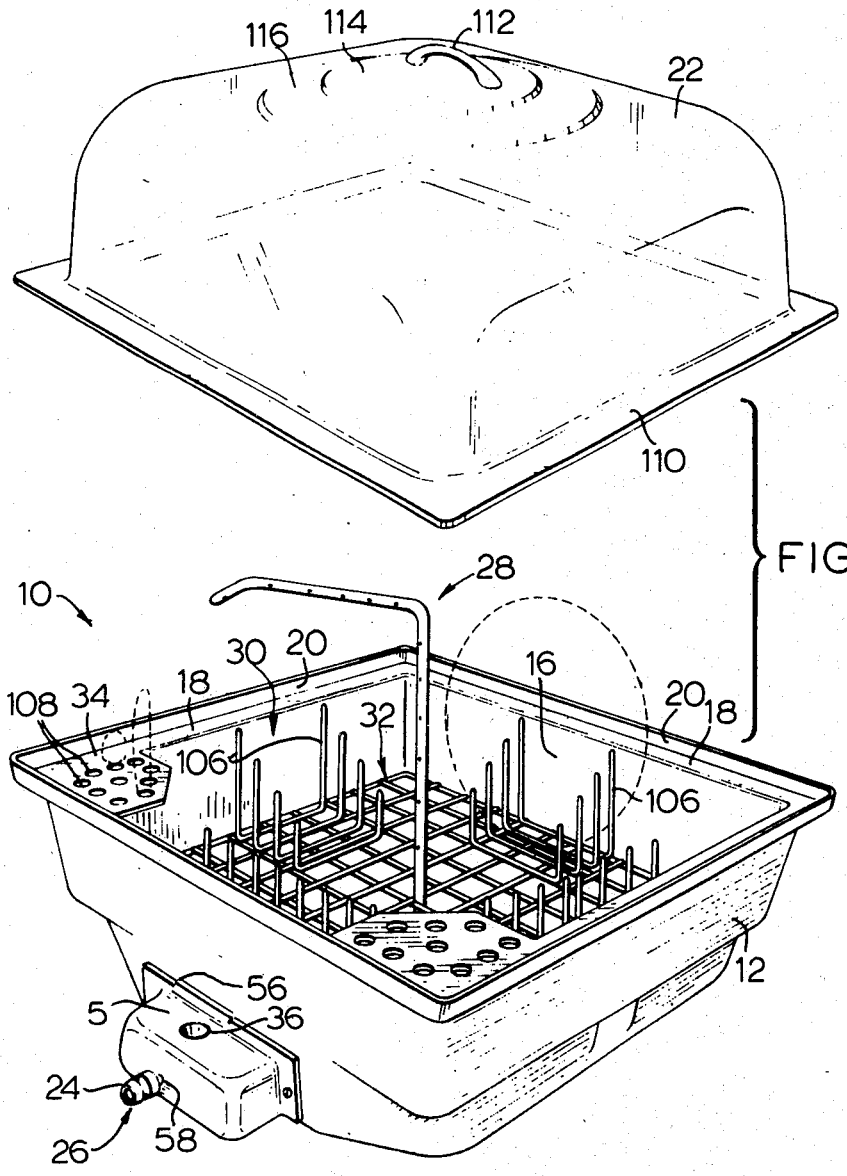
FIG. 1 is a partly exploded perspective view of a dishwasher incorporating the invention.

Referring to FIGS. 1 and 2, a water powered dishwasher 10 is shown, comprising container shell 12, having bottom 14, side walls 16, ledge 18 extending outwardly from each of side walls 16 at the upper end thereof, and peripheral wall 20 extending upwards from each of the outer edges of ledges 18; top 22; hose (not shown) connected (not shown) to the dishwasher 10 at the mouth 24 of water inlet 26, which hose is subsequently connected to a water faucet (also not shown); rotatable spray unit 28 secured for rotation within washing cavity 30 of dishwasher 10 to spray water onto the dishes; dish tray 32 to hold the dishes; cutlery rack 34; soap storage 36 having discharge aperture 37; and drainage apertures, one of which is shown at 38.

Water inlet 26, seen best in FIGS. 2 and 3, provided for introducing water from the hose (not shown) into the cavity 30, comprises feed tube 40, one end of which 42 forms mouth 24, extending inwardly a predetermined distance, and comprises cylindrical portion 39, and restricted cylindrical portion 45, (seen best in FIG. 3), which has an external diameter less than the internal diameter of portion 39, seen at 43; connector 48; cylindrical tube or conduit 52, and bearing member 68.

Intermediate mouth 24, and restricted cylindrical portion 45 and closer to portion 45 helical threading 46 is provided on cylindrical portion 39 for the purposes hereinafter described.

Cylindrical connector 48 is of a larger external diameter than portion 39 but of an internal diameter substantially the same as the external diameter of portion 39 at the helical threading 46. Connector 48 has an opening 50 therein and is secured as hereinafter described so that aperture 50 opens in an upward direction. The internal surfaces adjacent either end of connector 48 are helically threaded, at 47 and 49.

Cylindrical tube 52 is of the same external and internal diameter as cylindrical portion 39 and has the outer surface at end 54, helically threaded.

Soap storage 36 is disposed in support member 5 attached to a sidewall 16 at 56 by any suitable means. Feed tube 40 extends through aperture 58 in support member 5 so that the restricted cylindrical portion 45 is positioned below the discharge aperture 37 in soap storage 36. Therefore end 44 of feed tube 40 and thus end 44 of restricted cylindrical portion 45 remote from portion 39, is closer to side wall 16 than discharge aperture 37 when positioned. Connector 48 is secured to feed tube 40 at 46 by mating the helically threaded inner surface 47 of connector 48 with threaded portion 46. Connector 48 is so constructed such that opening 50 is directly below aperture 37 when connector 48 is connected to feed pipe 40 at 46 and connector 48 extends longitudinally inwardly a predetermined length such that end 44 of restricted cylindrical portion 45 is substantially vertically aligned with end 60 of connector 48. Cylindrical tube 52 is then connected at the other end of connector 48 by mating helical threading 54 to helical threading 49 on the inner surface of connector 48. With this arrangement a radial separation 63 exists between the outer surface 64 of restricted cylindrical portion 45 and the inner surface 66 of tube 52 for the purposes hereinafter described. Tube 52 extends from connector 48 below the bottom 14 of shell 12 to the centre thereof to a perpendicularly extending bearing member 68 and is secured into aperature 70 of bearing 68. At its lower end bearing member 68 has a chamber 72 into which the water from tube 52 is discharged. Passage 74 rises substantially perpendicular from chamber 72 and runs the remainder of the length of bearing member 68. Passage 74 has vertical outlet aperture 76 at its upper end which permits water to be discharged perpendicularly from bearing member 68, and diametrically opposed bleed apertures 78 and 80, below aperture 76, which permit water to be discharged laterally, each of apertures 78 and 80 being of less diameter than aperture 76, for example aperture 76 is ⅜ inch while each of apertures 78 and 80 is three-sixteenths inch.

The diameters of apertures 76, 78 and 80 must be such as to release sufficient water therethrough so that there is no back-pressure build-up in the water inlet 26. Their diameters of course depend on the internal diameter of portion 39 of feed tube 40 which in the case of the above dimensions is ¼ inch, the restricted portion 45 having a diameter of 5/32 inch and the connector 48 has a diameter of ⅜ inch.

The lower portion of member 68 is threaded at 80 to receive a threaded nut 82. Radially extending annular flange 84 is disposed a predetermined distance upwards on member 68. The portion of member 68 rising above flange 84 is of reduced cross-sectional area than threaded portion 80. Gasket 86 is disposed between flange 84 and bottom 14 when the member 68 is inserted through aperture 85 at the centre of bottom 14, to act as a liquid seal. Nut 82 is then threaded and tightened onto portion 80 to contact bottom 14 and urge flange 84 downwards. In this way, member 68 is maintained substantially perpendicular relative to bottom 14 at all times.

Seated on, and adapted to rotate about, bearing member 68, is rotary spray unit 28, comprising housing 86 comprised of a waxy polymer as for example, polyethylene, and has vertically extending tubular stem 88 of substantially the same internal diameter as aperture 76 extending perpendicular from the top of housing 86, and laterally extending tube 90 coaxial with apertures 78 and 80 when said housing is positioned over member 68 and of substantially the same internal diameter as apertures 78 and 80. Securing housing 86 to member 68 is a screw 92 which extends through housing 86 into a channel 94 circumferentially disposed in member 68 and defined at its upper extent by downwardly facing ledge 96; and, having apertures 78 and 80 opening thereinto. Screw 92 is threaded for that portion which passes through housing 86 but is unthreaded for that portion 98 which extends past housing 86 into channel 94. When water is introduced into bearing 68 and escapes through aperture 76, a vertical force is exerted on housing 86 forcing it upwards until unthreaded portion 98 of screw 92 contacts downwardly facing ledge

96. As the housing 86 rotates about member 68 by the action of the water, the unthreaded portion of the screw rides against the downwardly facing ledge 96 and acts as a thrust bearing. Both upwardly extending stem 88 and laterally extending stem 90 have positioned apertures through which water, received by the stems, is sprayed in jets, each jet having at least a lateral force component. Stem 88 extends vertically a predetermined distance and is then best at right angles becoming portion 100 extending over the cavity 30. Angled apertures to discharge water are also disposed therein. As a result, water ejected through stem 88 and portion 100, rotates the spray unit 28.

The end 102 of portion 100 is angled generally downwardly and is closed by a plug (not shown) which may have an aperture therein for discharge of water as shown at 104.

Dish tray 32 is adapted to seat on the bottom of the cavity above the lower stem 90. U-shaped dish supports 106 of varying sizes are provided on the tray such that large plates can be supported near the periphery of the shell and smaller dishes at the center. Cutlery tray 34 is provided as an extension of ledge 18, having apertures 108 through which cutlery may be inserted or such cutlery trays may be substituted by baskets to hold the cutlery.

Top 22 is provided having base peripheral flange 110 to seat on ledge 18 and abut against peripheral walls 20. Centrally disposed at the upper portion of the top is a handle 112 and disposed concentrically thereabout are circular steps 114 and 116 for support.

At the bottom of shell container 12, are channels 118 and 120 seen best in FIG. 2, the floors of which are sloped to drainage apertures such as aperture 38 in channel 118.

To operate, the hose if first connected to the mouth 42 of the water inlet feed tube 40, and to a faucet, soap storage 36 is then filled with liquid detergent, and the cutlery and dishes appropriately arranged in the cavity. The hot water is then turned on, and passes through the feed tube 40 through restricted portion 45 and is ejected into tube 52. As a result, the structure of the water inlet, comprising feed pipe 40 having restricted cylindrical portion 45, connector 48 and cylindrical tube 52 and their disposition relative to one another, act, is is thought, as an aspirator, sucking air through opening 50 in connector 48 into cylindrical tube 52. Therefore soap discharged through aperture 37 from storage 36 into aperture 50 of connector 48 is drawn thereinto both by gravity and suction. The soap is then mixed with the water in the volume 63 between end 60 of connector 48 and end 44 of restricted cylindrical portion 45, passes with the water, through tube 52, through unit 28, and is sprayed onto the dishes. When the soap in the storage is exhausted, the dishes in the cavity are rinsed with clear water. Clear water added to the sotrage 36 after the soap has been exhausted, efficiently rinses the well, due also to the suction of the structure.

After the washing operation is completed, the water is turned off, and the top 22 is offset relative to container shell 12 so that a connection current rises from the cavity 30, which cavity is vented to atmosphere through for example, aperture 38 and assists in drying the dishes.

The rotary spray unit 28 may comprise aluminum, although the housing 86 preferably comprises a polymeric material as for example, polyethylene or acrylic.

The shell container 12, support member 55, and top 22 also preferably comprise a polymeric material both of which are preferably vacuum formed, the top preferably comprising UVEX (trade mark). The dish tray may be wire formed and coated with a polymeric material, e.g. vinyl.

As many changes could be made in carrying out the above constructions without departing from the scope of the invention, it is intended that all matter contained in the above description or shown in the accompanying drawings shall be interpreted as illustrative only and not in a limiting sense.

I claim:

1. A soap dispenser for a water powered dishwasher, suitable for dispensing soap from storage to be mixed uniformly with water passing through a water inlet, the dishwasher having a container shell and top defining a washing and rinsing cavity therebetween a water inlet extending from one side of the container shell below the bottom of the shell, to the centre thereof into a washing cavity, a water inlet and a water outlet, and rotatable spray means adapted to rotate about the water inlet extending into the cavity, said soap dispenser comprising a soap storage in open communication with the atmosphere through at least a downwardly directed aperture, through which soap is discharged, an upwardly directed opening in the top of the water inlet disposed directly below the downwardly directed aperture for receiving the discharged soap and means in the water inlet when water is passing through the inlet, to cause a continuous suction on the soap discharged from said storage and assist to draw the soap through the opening into the water inlet to be mixed with the water passing therethrough.

2. The apparatus of claim 1 wherein the soap storage is also in open communication with the atmosphere at the top thereof when the dishwasher is in operation.

3. The apparatus of claim 1, wherein said means in the water inlet comprises a restricted tube of lessor radial extent than the minimum radial extent of the inlet and so secured within the inlet to receive all water entering the mouth of the water inlet, pass it below the upwardly directed opening in the water inlet still controlled by the said restricted tube, and discharge the water into the inlet on the side of the opening remote from the mouth, whereat soap is mixed with the water.

4. The apparatus of calim 3 wherein said opening in the water inlet is disposed in a portion of the water inlet of of greater radial extent than the remaining portion of the water inlet.

5. A water powered dishwasher, comprising a container shell, a top adapted to seat on said container shell to define therebetween a washing and rinsing cavity, a water inlet and a water outlet, a soap storage having an aperture in the bottom thereof in communication with the atmosphere for the downward discharge of soap therethrough, said water inlet extending from its mouth proximate one side of the container shell, below the bottom of the shell to the center thereof and into the cavity secured in substantially vertical relation to said bottom at all times, said water inlet having a cylindrical tubular first portion of predetermined diameter extending longitudinally from its mouth a predetermined distance to a restricted tubular portion of predetermined length secured thereto to receive all water passing through said first portion, said restricted portion of lesser outer diameter than the internal diameter of said first portion, a second tubular portion of greater outer diameter than said first portion but of substantially the same internal diameter as the outer diameter of said first portion to be secured to said first portion at the end thereof remote said mouth, said second portion having an upwardly directed opening therein when secured to said first portion, said restricted portion being such as to extend from said first portion, below the opening in said second portion when said second portion is secured to said first portion to the side of the opening remote the mouth of the water inlet, the portion of said water inlet within the cavity having a first aperture disposed proximate its upper end to discharge a column of water substantially perpendicular to the bottom of said container shell, and at least one second aperture of lesser cross-sectional area than the water column, disposed in said water inlet means below said first aperture; rotatable spray means secured for rotation about the inlet means, said rotatable spray means have a lower tube disposed substantially parallel to the bottom of said container shell and in communication with said at least one second aperture to receive a flow of water therfrom; said lower tube having apertures diposed in the wall of said tube to effect outflow of jets of water therefrom, each jet having horizontal and vertical force components; said rotatable spray means further comprising a perpendicularly disposed tube relative to said container shell bottom and in communication with said first aperture to receive said column of water and to discharge the water through apertures in the wall of said tube as jets of water, each jet having at least a horizontal force component.

6. The dishwasher of claim 5 wherein the internal diameter of said second portion from proximate the end of the restricted tubular portion remote said first portion to its outlet within the cavity, is substantially the same as the internal diameter of said first portion.

7. The dishwasher of claim 5 wherein said rotatable spray means is maintained for rotatable co-operation with said inlet means by retaining means extending through said rotatable spray means to ride in a circumferentially disposed channel in the outer wall of said inlet, said channel being disposed in said wall in a plane parallel to the bottom of said container shell; the portion of said retaining means which projects into said channel having a smooth surface to contact a downwardly facing ledge defining the furthestmost upper extent of said channel when said retaining means is moved upwardly.

8. The dishwasher of claim 5 wherein said rotatable spray means includes a housing proximate its lower end to support said lower and perpendicularly disposed tubes for rotation about said inlet means, and said housing comprises a polymeric material.

9. The dishwasher as claimed in claim 8 wherein said housing comprises polyethylene.

10. The dishwasher as claimed in claim 5 wherein said water passage of said inlet means is maintained substantially perpendicular to the bottom of said container shell at all times by laterally extending flange means disposed on said inlet means on the portion thereof that extends into said cavity about the bottom of said container shell so as to seat proximate the upper surface of the bottom of said container shell; and by threaded nut receiving means disposed below the bottom of said container shell to receive a nut to be threaded thereon to contact the under surface of the bottom of said container shell, and so as to urge said flange downwards towards said bottom.

11. A dishwasher as claimed in claim 5 wherein said top is reinforced by concentrically disposed circular steps disposed at substantially the centre of said top.

12. A dishwasher as claimed in claim 5 wherein said top sits on a ledge formed in said container shell; and further comprises cutlery holding means having a plurality of apertures formed in an inwardly disposed extension of said ledge.

13. A dishwasher as claimed in claim 5 wherein said perpendicularly disposed tube further includes an extension thereof disposed at substantially right angles thereto, proximate said top when said top is closed onto said container shell; said extension having apertures therein to discharge water and having the end thereof which is remote from said perpendicularly disposed tube being further bent and directed generally towards said container shell bottom; said extension being closed at said remote end and having an aperture in said ent to discharge water in a plan substantially perpendicular to the plane of disposition of the apertures disposed in said extension.

14. The dishwasher as claimed in claim 5 wherein the ratio of the cross-sectional area of said at least one second aperture in the water inlet extending into the cavity to the cross-sectional area of said first aperture is about 1:2.

15. The dishwasher as claimed in claim 5 wherein the internal diameter of said at least one second aperture and the diameter of said first aperture is 3/16 inch and ⅜ inch respectively, and the internal diameter of the first tube portion and the restricted cylindrical portion are ¼ inch and 5/32 inch respectively.

16. For use in a water powered dishwasher having a container shell and top defining a washing and rinsing cavity therebetween, a water inlet and a water outlet and rotatable spray means, an improved soap dispenser comprising a soap storage having a generally downwardly directed discharge aperture disposed above a portion of the inlet intermediate the mouth of the inlet and the washing cavity and means in the water inlet to act on the soap discharged from said soap storage by suction to draw the soap into the water inlet to be mixed with the water, said means having a second tubular portion extending below the soap storage having an upwardly directed opening disposed directly below the discharge aperture in the storage, and secured at either end thereof, first and third equal diameter tubular portions of lesser outer diameter than the outer diameter of said second portion but of substantially the same outer diameter as the internal diameter of said second portion, and a fourth tubular portion of lesser outer diameter than the internal diameter of said first or third portions, attached at one end to said first portion and secured thereto to receive all water passing therethrough, said fourth portion extending through said second portion and terminating proximate the juncture of said second and third portions whereby soap drawn into said opening by gravity and suction, mixes with water at the juncture of said second and third tubular portions.

17. The soap dispenser of claim 16 wherein the internal diameters of said first tubular portion and said fourth portion are ¼ inch and 5/32 inch respectively.

* * * * *